US009320929B2

(12) United States Patent
Koiwa

(10) Patent No.: US 9,320,929 B2
(45) Date of Patent: Apr. 26, 2016

(54) PROTECTIVE CAP OF SPRINKLER HEAD AND SPRINKLER HEAD

(71) Applicant: SENJU SPRINKLER CO., LTD., Tokyo (JP)

(72) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 0 days.

(21) Appl. No.: 14/485,955

(22) Filed: Sep. 15, 2014

(65) Prior Publication Data

US 2015/0083442 A1 Mar. 26, 2015

(30) Foreign Application Priority Data

Sep. 26, 2013 (JP) ..... 2013-200087
Jun. 26, 2014 (JP) ..... 2014-130857

(51) Int. Cl.
*A62C 31/28* (2006.01)
*A62C 37/08* (2006.01)
*A62C 35/68* (2006.01)

(52) U.S. Cl.
CPC ..... *A62C 35/68* (2013.01); *A62C 37/08* (2013.01)

(58) Field of Classification Search
CPC ..... A62C 31/28; A62C 35/68; A62C 37/08; A62C 37/09; A62C 37/11
See application file for complete search history.

(56) References Cited

U.S. PATENT DOCUMENTS 3,727,695 A 4/1973 Danton
4,014,388 A * 3/1977 Anderson ..... 169/37
5,080,176 A * 1/1992 Polan et al. ..... 169/37
5,152,344 A * 10/1992 Fischer et al. ..... 169/37
6,484,809 B1 * 11/2002 Elder ..... 169/37
6,840,329 B2 * 1/2005 Kikuchi et al. ..... 169/37
7,540,330 B2 * 6/2009 Orr et al. ..... 169/37
D683,425 S 5/2013 Koiwa
D721,418 S * 1/2015 Koiwa ..... D23/214
D721,419 S * 1/2015 Koiwa ..... D23/214
2004/0134670 A1 7/2004 Orr et al.
2007/0215720 A1 * 9/2007 Koiwa ..... 239/201
2013/0020406 A1 1/2013 Koiwa
2013/0306334 A1 11/2013 Koiwa

FOREIGN PATENT DOCUMENTS

JP 60-63364 U 5/1985
JP 2001-161852 A 6/2001
JP 2002-210034 A 7/2002
WO WO2011/125921 A1 10/2011

OTHER PUBLICATIONS

European Search Report for European Patent App. No. 14185087.5 (Jul. 15, 2015).

* cited by examiner

*Primary Examiner* — Darren W Gorman
(74) *Attorney, Agent, or Firm* — Cermak Nakajima & McGowan LLP; Tomoko Nakajima

(57) ABSTRACT

A protective cap for a sprinkler head and a sprinkler head provided with the protective cap, in which the protective cap for a sprinkler head has a cylindrical shape that is capable of accommodating a sprinkler head therein, the protective cap having an opening on an upper side thereof and a base provided on a lower side thereof, a base side of the protective cap having a drain hole therein, a seat portion on which a surface of the sprinkler head sits being provided inside the protective cap on the base side, in which the seat portion is disposed on an opening side with respect to the drain hole.

6 Claims, 7 Drawing Sheets

PRIOR ART (a)

PROTECTIVE CAP OF SPRINKLER HEAD AND SPRINKLER HEAD

BACKGROUND OF THE INVENTION

1. Field of the Invention

The present invention relates to a protective cap that protects a sprinkler head for extinguishing fire from external shock and dirt and to a sprinkler head provided with the protective cap.

2. Description of the Related Art

Sprinkler heads are disposed on ceiling surfaces and wall surfaces inside buildings. A sprinkler head includes, on one end side thereof, a nozzle that can be connected to a pipe installed inside a space above the ceiling or inside a wall and is provided with a thermally responsive unit on the other end side. During normal times, the thermally responsive unit supports a valve body that closes the nozzle.

An example of the above-described sprinkler head is illustrated in FIGS. 11 and 12 of International Publication Pamphlet No. WO 2011/125921. A sprinkler head SH illustrated in FIG. 7 of the present application is mostly disposed inside a space above a ceiling and, on the front side of the ceiling, a lower end of the sprinkler head, that is, a deflector D, is disposed in a projecting manner.

During installation work of the sprinkler head SH, a leak inspection is carried out after connecting the sprinkler head SH to a pipe P laid in the space above the ceiling. From after the completion of the leak inspection until the installation work of the ceiling boards is completed, a protective cap C is mounted on the sprinkler head SH. The protective cap C is for protecting the sprinkler head SH from external shock while the sprinkler head SH is stored, transferred, and while the installation work is carried out, and is for preventing adhesion of paint and foreign matters such as dust during the installation work.

A drain hole E is provided in a base of the protective cap C so that leakage of water can be checked during the leak inspection. The sprinkler head SH illustrated in FIG. 7 is configured so that the deflector D is disposed so as to be exposed to the outside of the body and so that the underside of the deflector D is adjacent to the base of the protective cap C while the protective cap C is in a mounted state.

If the is any leakage from a gap between the pipe P and a screw T or from a nozzle (not shown) inside the screw T, the water that has leaked out flows to the base of the protective cap C and is discharged from the drain hole E. However, due to the gap between the base of the protective cap C and the underside of the deflector D, surface tension of water is created that causes the water to disadvantageously take a considerable amount of time to be discharged from the drain hole E. As such, there is a concern of overlooking the sprinkler head in which a leakage has occurred because of water not being discharged within the inspection time.

SUMMARY OF THE INVENTION

Accordingly, in the present invention, in view of the above problem, a first object thereof is to facilitate discharge of water from the drain hole of the protective cap in the sprinkler head. Furthermore, a second object is to prevent adhesion of paint and foreign matters such as dust during an installation work.

In order to achieve the above objects, the present invention provides a protective cap for a sprinkler head and a sprinkler head that are described below.

In other words, provided is a protective cap for a sprinkler head having a cylindrical shape that is capable of accommodating a body of the sprinkler head therein, the protective cap having an opening on an upper side thereof and a base provided on a lower side thereof, a drain hole being formed in a base side of the protective cap, a seat portion on which a lower end surface of the sprinkler head sits being provided inside the protective cap on the base side, in which the seat portion is formed on an opening side with respect to the drain hole.

According to such a configuration, since the lower end surface of the sprinkler head sits on the seat portion of the protective cap while the protective cap is mounted on the sprinkler head, the lower end surface of the sprinkler head and the base of the protective cap are spaced apart from each other. Accordingly, no water that has leaked out from the nozzle will remain between the lower end surface of the sprinkler head and the base of the protective cap because of a surface tension, and water can be made to easily flow out though the drain hole. Furthermore, when spray-painting the ceiling surface, even if paint passes through the drain hole and intrudes into the protective cap, it is possible to prevent the paint from easily reaching the seat portion by disposing the drain hole in a space that sets the base and the seat portion away from each other at a predetermined distance.

The present invention described above may be configured with a gripping portion that extends downwards from the base side. According to such a configuration, when pulling out the protective cap from the sprinkler head, the pulling-out work can be carried out by engaging fingers or a tool to the gripping portion.

In the present invention described above, a flange portion may be formed on the lower end of the protective cap and the drain hole may be provided in a portion on the inside with respect to the edge of the flange portion. According to such a configuration, since the drain hole is provided at a portion behind the flange portion, when the ceiling surface is spray-painted, it is possible to prevent the paint from flowing into the protective cap and adhering onto the surface of the sprinkler head.

Furthermore, by providing an extension portion that is formed by extending the lateral side of the protective cap below the base, paint that is sprayed from the lateral side with respect to the sprinkler head can be prevented from easily reaching the base of the protection cap.

In addition to the above configuration, the seat portion may be provided with an elastic body allowing the seat portion to be displaced inside the protective cap. The above configuration can protect the surface of the sprinkler head that is in contact with the seat portion and, further, prevent a movable member of the sprinkler head from being displaced inside the protective cap.

As described above, the present invention can provide a protective cap for a sprinkler head and a sprinkler head that are capable of having water that has leaked out from the nozzle to flow out from the drain hole easily without the water remaining between the deflector and the base of the protective cap because of a surface tension.

DESCRIPTION OF THE PREFERRED EMBODIMENTS

First Embodiment (FIGS. 1 to 4)

FIGS. 1 to 4 illustrate a protective cap H1 and a sprinkler head S1. The protective cap H1 has a cylindrical shape and includes an inner cylinder T1 and an outer cylinder T2.

The sprinkler head S1 is accommodated inside the inner cylinder T1. An opening 10 is formed on the upper side of the protective cap H1 and a base 11 is formed on the lower side. A drain hole 12 is formed in the base 11. Water that has leaked out from a nozzle 21 of the sprinkler head S1 flows down to the base of the protective cap H1, passes through the drain hole 12, and flows out to the outside.

Figure 3:
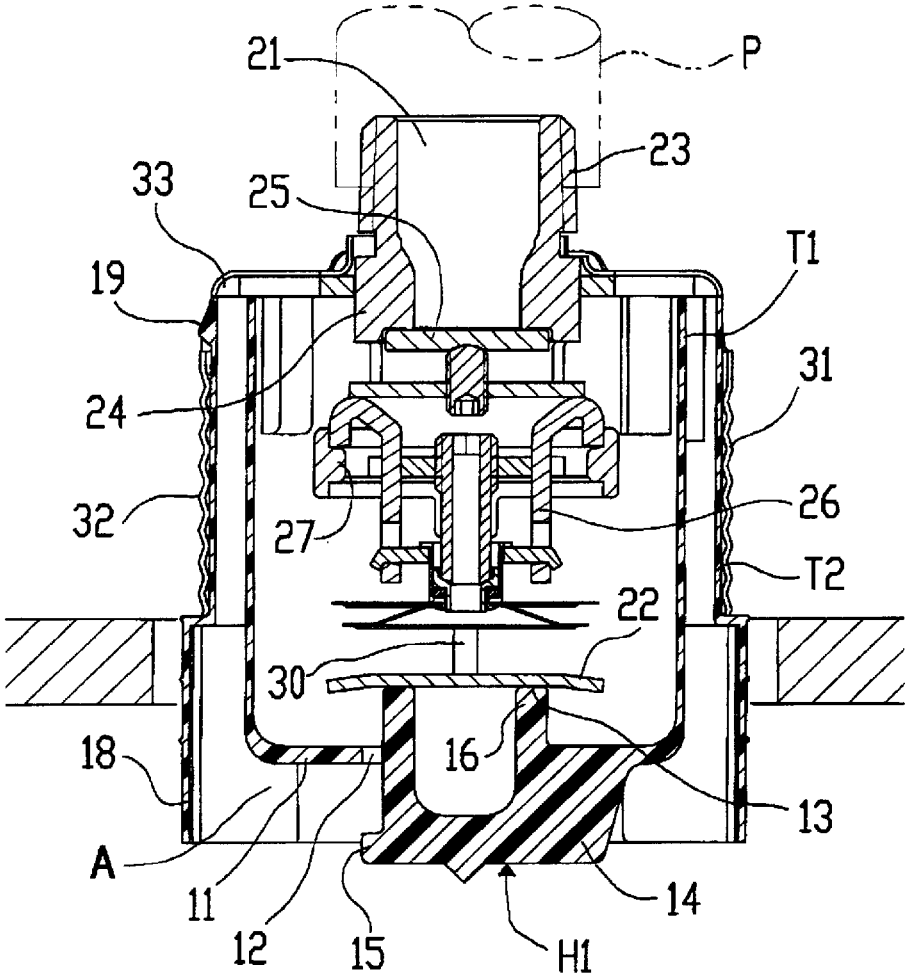
FIG. 3 is a cross-sectional view taken along line III-III of the sprinkler head of FIG. 1 on which the protective cap is mounted.
Figure 4:
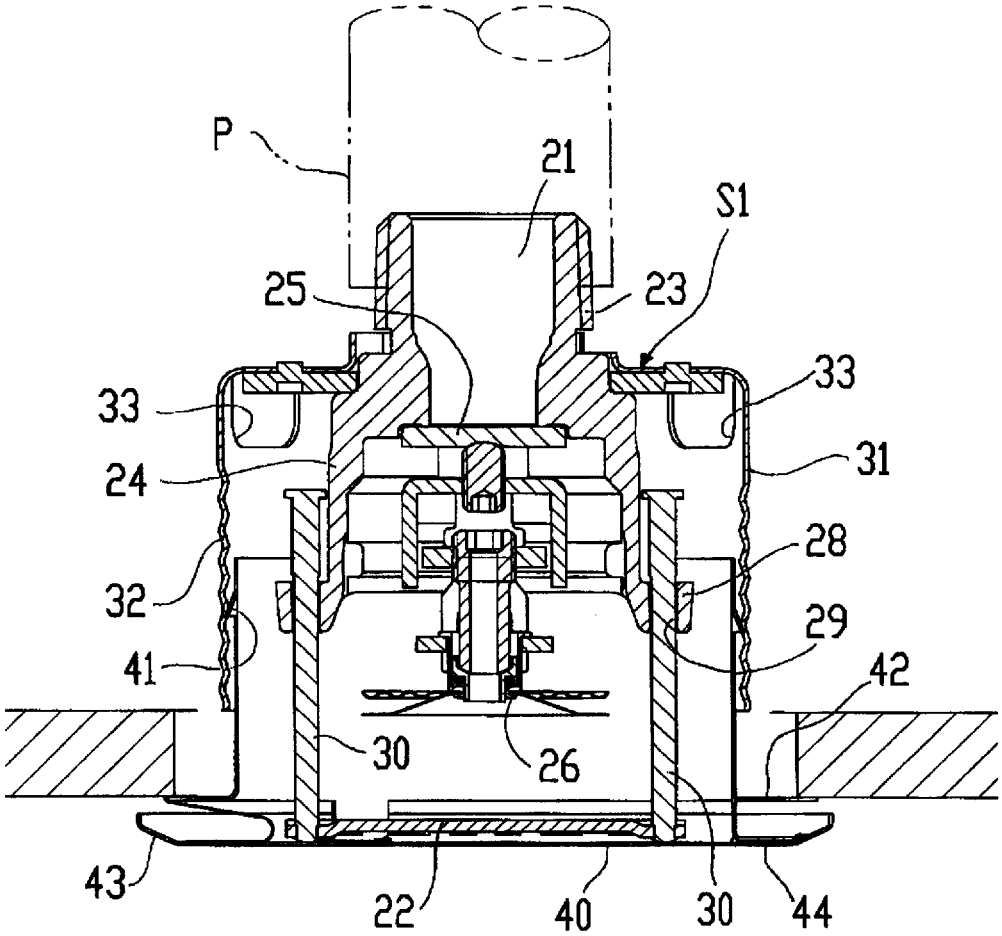
FIG. 4 illustrates an explanatory drawing of the sprinkler head of FIG. 1 after an installation work has been carried out.

The protective cap H1 is provided with a seat portion 13 that is formed so as to protrude in the opening 10 direction from the inner side of the base 11. The upper surface of the seat portion 13 is a ring-shaped seating surface. As illustrated in FIG. 3, a plate-shaped deflector 22 that is disposed at the lower end of the sprinkler head S1 sits on the seat portion 13. In the base 11, in the vicinity of the portion where the seat portion 13 protrudes, the drain hole 12 described above is formed as a circular-arc-shaped elongated hole that extends along the outer peripheral shape of the seat portion 13. An edge of the seat portion 13 and the inner cylinder T1 are spaced apart from each other. The space between the edge of the seat portion 13 and the inner cylinder T1 facilitates water that has leaked out from the sprinkler head S1 to flow towards the drain hole 12 that is formed below the seat portion 13. Accordingly, water can be discharged in a short time and a defect of overlooking the sprinkler head in which a leakage has occurred because of water not being discharged within the inspection time of the leak inspection will not occur.

A gripping portion 14 that extends downwards is formed on the outer side of the base 11. The gripping portion 14 has a trifurcated shape that is a shape allowing the fingers to easily hold the gripping portion 14. A flange portion 15 is formed at the distal end of the gripping portion 14. The flange portion 15 is integrally formed with the lower portion of a cylindrical portion 16 that extends downwards from the seat portion 13. When pulling out the protective cap H1 from the sprinkler head S1, the pulling-out work can be carried out by hooking fingers or a tool into the flange portion 15.

Figure 1:
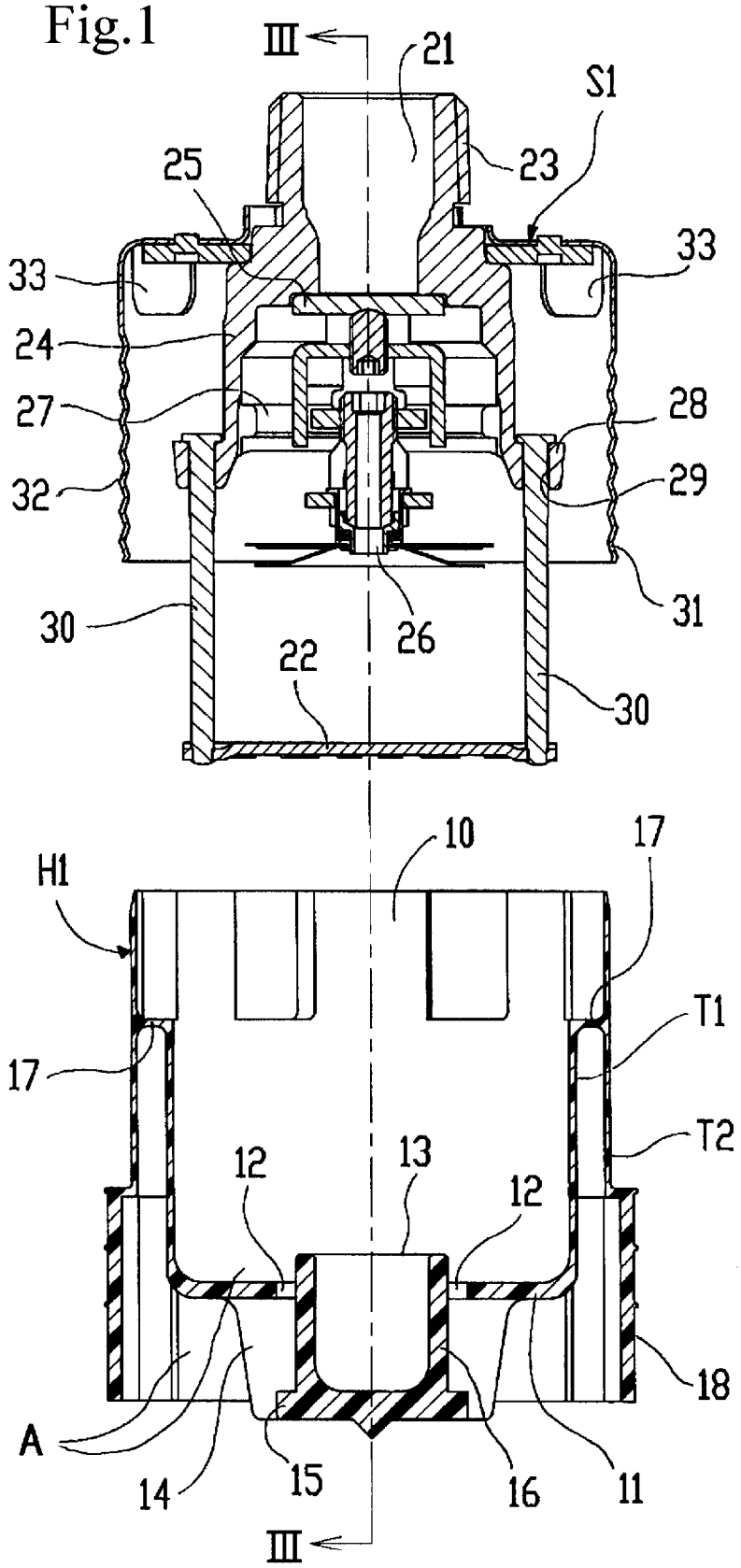
FIG. 1 illustrates cross-sectional views of a protective cap and a sprinkler head of a first embodiment.
Figure 2:
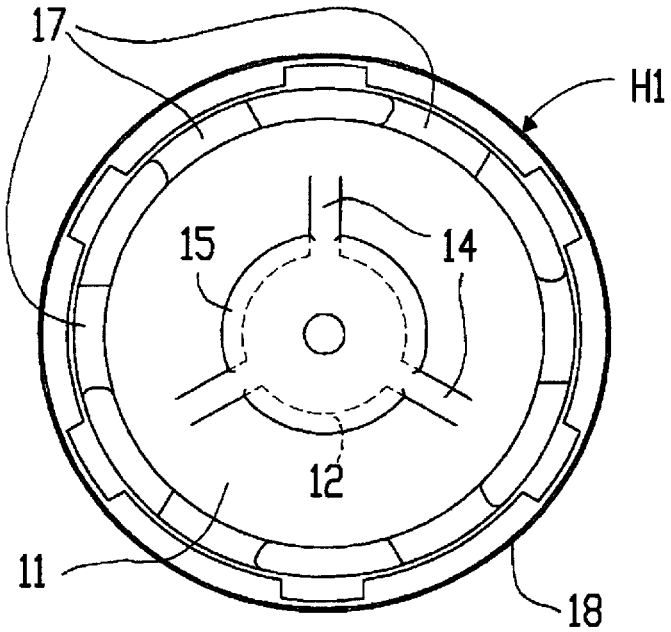
FIG. 2 is a bottom view of the protective cap of FIG. 1.

FIG. 2 is a bottom view of the protective cap H1. The drain hole 12 is provided at a portion in the base 11 that is on the inner side with respect to an edge of the flange portion 15 such that the drain hole 12 is hidden by the flange portion 15.

The outer cylinder T2 contains the inner cylinder T1 therein and is connected to the inner cylinder T1 with a connection portion 17. A step is formed in the lateral side of the outer cylinder T2 such that an outside diameter of a portion below the step is larger than an outside diameter of a portion above the step. The lower portion that is formed with a larger outside diameter serves as an extension portion 18. A lower end of the extension portion 18 is formed so as to extend below the base 11. Furthermore, a space A that sets the seat portion 13 and the lower end of the extension portion 18 apart from each other at a predetermined distance is provided. The drain hole 12 is disposed inside the space A.

Projections 19 are formed on the lateral side of the outer cylinder T2 (see FIG. 3). The projections 19 are configured so that they can be engaged with a support cup 31 described later. The projections 19 can be engaged with the edges of openings 33 of the support cup 31. Other than the above, the projections 19 can be engaged with a spiral groove 32 as well.

The sprinkler head S1 has a similar configuration as those described in Japanese laying-open publication No. 2011-218062 and Japanese laying-open publication No. 2012-80961; accordingly detailed description of the structure of the sprinkler head S1 will be omitted and only the portions related to the present invention will be described. The sprinkler head S1 includes a body 24 that is provided with, on an upper end side thereof, a male screw 23 to which a water supply pipe P is connected. The inner side of the male screw 23 is the nozzle 21 described above. The nozzle 21 is filled therein with water inside the water supply pipe P. The lower end side of the nozzle 21 is closed by a valve body 25.

The valve body 25 is supported by a thermally responsive unit 26. The thermally responsive unit 26 is locked to an inside flange 27 formed at the lower portion of the body 24. The thermally responsive unit 26 being decomposed by the heat of a fire falls out from the body 24. When the thermally responsive unit 26 is decomposed and operated, the support of the valve body 25 is removed and the valve body 25 is detached from the nozzle 21 such that the nozzle 21 is opened.

In the body 24, a projection 28 to which the deflector 22 is connected is formed outside the inside flange 27. Holes 29 are provided in the projection 28 and pins 30 that are provided in the deflector 22 are inserted in the holes 29 in a slidable manner. Upper ends of the pins 30 are flanged such that the pins 30 can be locked to the projection 28.

The deflector 22 is disposed along a line extended from the discharge port of the nozzle 21. As described above, the deflector 22 is locked to the projection 28 of the body 24 with the pins 30. The specification and the product name of the sprinkler head S1 is indicated on the underside of the deflector 22. The indication portion is covered and hidden by the seat portion 13 when the protective cap H1 is in a mounted state. Furthermore, as illustrated in FIG. 3, the deflector 22 is placed on the seat portion 13 when the protective cap H1 is mounted on the sprinkler head S1. Accordingly, water that has leaked out from the nozzle 21 and that has reached the deflector 22 further flows to the base 11 side from the seat portion 13 and is discharged to the outside from the drain hole 12.

The support cup 31 with cylindrical shape is provided outside the body 24. The protective cap H1 is inserted inside the support cup 31. The spiral groove 32 is carved in a lateral side of the support cup 31, and a cover unit 40 is engaged to the spiral groove 32 and is connected to the support cup 31. The plurality of openings 33 are formed in the upper portion of the support cup 31. The projections 19 of the protective cap H1 that are described above are engaged to the openings 33.

The cover unit 40 is connected to the support cup 31 to cover and hide the sprinkler head S1 from the room side. A plurality of projections 41 are formed on the lateral side of the cylindrical portion of the cover unit 40. The projections 41 are engaged to the spiral groove 32 described above. A flange 42 is formed in the lower portion of the cover unit 40 and, further, a cover plate 43 is disposed under the flange 42. A tip of a leg formed in a suspended manner from the flange 42 is bent so as to be parallel to the cover plate 43. The cover plate 43 and the flange 42 are joined together with a Fusible alloy 44.

An installation procedure of the sprinkler head S1 described above will be described next.

First, the sprinkler head S1 is connected to the water supply pipe P. Then, in order to carry out a leak inspection, water is filled into the water supply pipe P and pressure is applied to the water supply pipe P until a predetermined pressure is reached. After elapse of a predetermined time, leakage of water from the joint of the pipe and the sprinkler head S1 is checked. Whether there is any leak of water from the sprinkler head S1 is determined by whether water is flowing out from the drain hole of the protective cap H1.

Since the protective cap H1 is provided with the seat portion 13, the deflector 22 sits on the seat portion 13 and is set apart from the base 11; accordingly, no water will remain between the base 11 and the deflector 22 due to a surface tension. If water leaks out to the inside of the protective cap H1 from the nozzle 21 or from the joint between the water supply pipe P and the male screw 23, since the water will promptly flow out from the drain hole 12 of the base 11, leakage can be easily identified.

Replacement and repair will be carried out to the portion where leakage has occurred. After passing the leak inspection, ceiling boards are installed. The protective cap H1 protects the sprinkler head S1 from external force when the ceiling boards are installed.

Then, there are cases in which the ceiling is spray-painted after the installation of the ceiling boards. In such a case, there is a risk of the paint intruding into the protective cap H1 through the drain hole 12 of the protective cap H1. The present embodiment prevents intrusion of the paint into the protective cap H1 from the drain hole 12 by providing the space A from the seat portion 13 to the lower end of the extension portion 18 and by arranging the drain hole 12 inside the space A. Specifically described, while paint is sprayed to the sprinkler head S1, on which the protective cap H1 is mounted, from the lateral direction, the paint is blocked by the outer peripheral portion of the extension portion 18 so that the paint will not intrude into the protective cap H1 through the drain hole 12. Furthermore, paint that is sprayed from below the sprinkler head is blocked by the flange portion 15 such that the paint does not intrude into the protective cap H1 through the drain hole 12.

Even with the above configuration, some of the diffused paint enters the space A; however, since the space A is separated into the upper portion and the lower portion with the base 11 in which the drain hole 12 is provided, the paint needs to pass through the drain hole 12 in order to intrude into the protective cap H1. However, most of the paint that has entered the space A impinges against the base 11 and the inner peripheral surface of the extension portion 18 and its momentum is reduced; accordingly, the amount of paint passing through the drain hole 12 and intruding into the protective cap H1 is small. Furthermore, since the momentum of the paint is decreased and since the drain hole 12 and the undersurface of the deflector 22 are set apart by the seat portion 13, paint that adheres to the surface of the deflector 22 is suppressed to a further small amount. Furthermore, since the indication portion of the specification, the product name, and the like are covered and hidden by the seat portion 13, no paint will adhere to the indication portion. Accordingly, when later replacing the sprinkler head S1, no paint will be adhered to the indication portion of the specification, the product name, and the like, and the indicated contents can be in an easily recognizable state.

Then, the protective cap H1 is dismounted. Since the gripping portion 14 is provided in the protective cap H1, the gripping portion 14 is held by the fingers and the protective cap H1 is pulled out from the support cup 31. Alternatively, if the sprinkler head S1 is disposed at a position that is out of reach, for example, a tool for dismounting, the length of which can be adjusted, that is described in Japanese Registered Utility Model No. 3027985 can be used to hook the tool into the flange portion 15 and to pull out the protective cap H1.

Finally, the cover unit 40 is mounted on the sprinkler head S1. The projections 41 that are formed on the lateral side of the cover unit 40 are locked to the spiral groove 32 of the support cup 31. The cover unit 40 is moved to a position where the flange 42 comes close to the underside of the ceiling boards. The sprinkler head S1 is covered and hidden by the cover plate 43 such that the sprinkler head S1 is hidden from the room. With the above, the installation of the sprinkler head S1 is completed.

Figure 5:
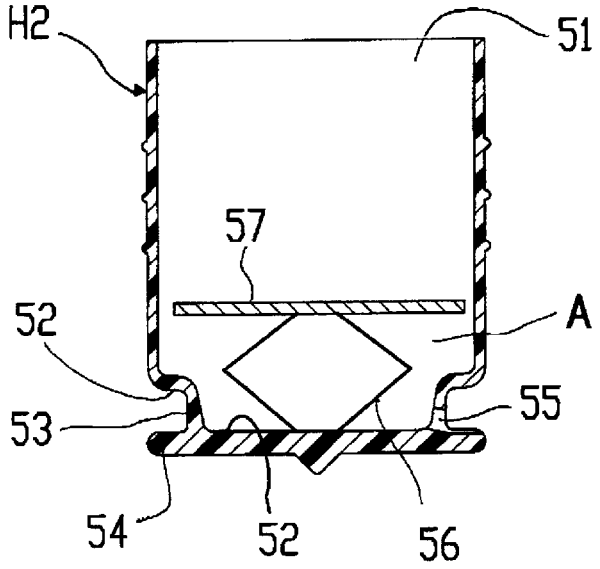
FIG. 5 is a cross-sectional view of a protective cap of a second embodiment.
Figure 6:
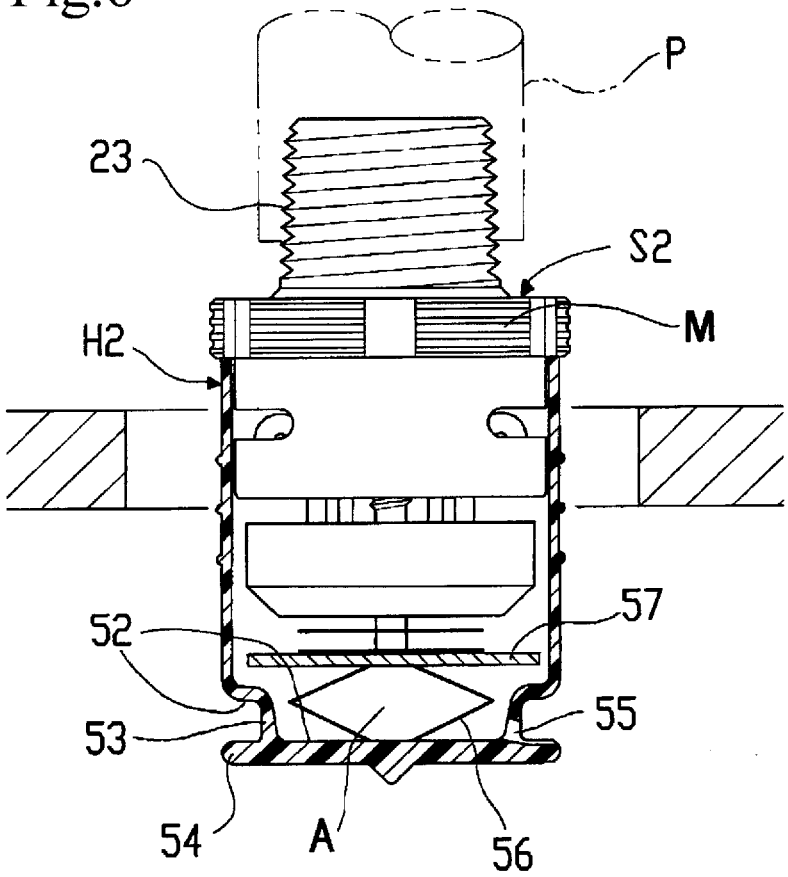
FIG. 6 is a cross-sectional view of the protective cap of FIG. 5 in which the sprinkler head is accommodated.
Figure 7:
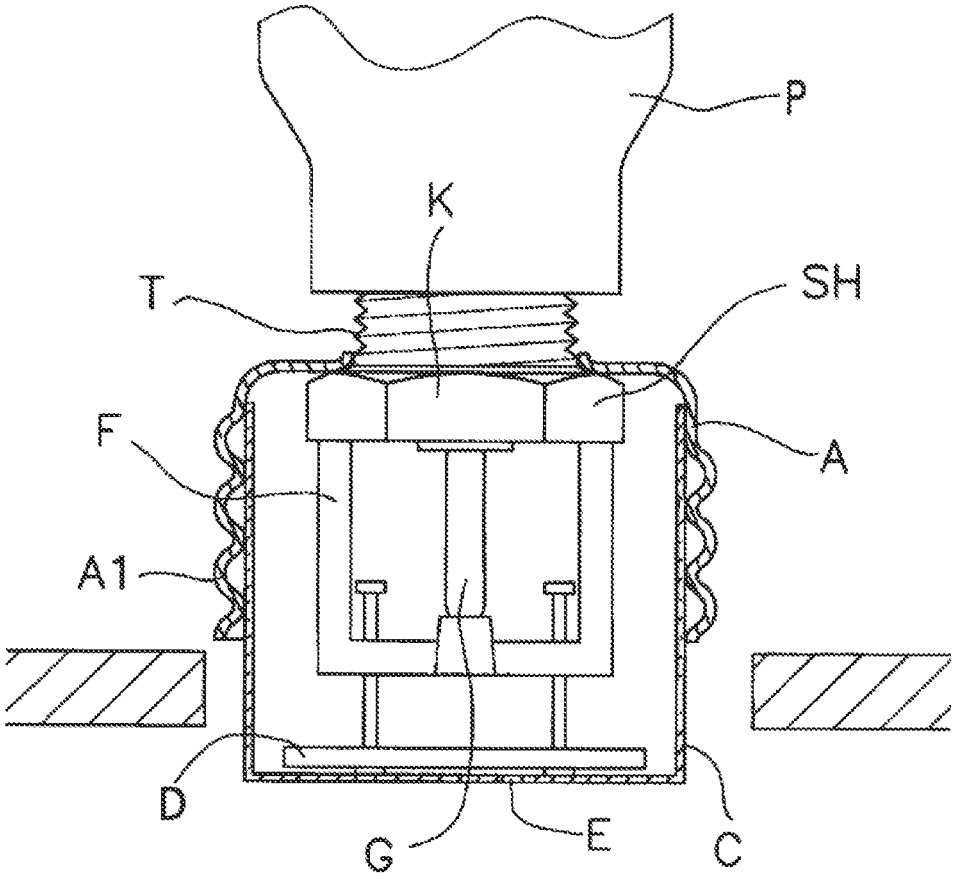
FIG. 7 is a cross-sectional view including a conventional protective cap and a conventional sprinkler head.

Second Embodiment (FIGS. 5 to 6)

A protective cap H2 of a second embodiment illustrated in FIGS. 5 and 6 is mounted on a sprinkler head S2.

The protective cap H2 has a cylindrical shape and the sprinkler head S2 is accommodated therein. An opening 51 is formed on an upper side of the protective cap H2 and a base 52 is formed on a lower side thereof. A cylindrical portion 53 that extends downwards is formed in the base 52. An outside diameter of the cylindrical portion 53 is smaller than an outside diameter of the base 52, and the inner side portion of a lower end of the cylindrical portion 53 is closed by the base 52.

A flange portion 54 is formed outside the lower end of the cylindrical portion 53. An outside diameter of the flange portion 54 is larger than the outside diameter of the cylindrical portion 53 and is about the same or smaller than an outside diameter of the base 52 above the cylindrical portion 53. A drain hole 55 is formed in a lateral side of the cylindrical portion 53.

An elastic body 56 is disposed on the surface of the base 52 on the inner side of the flange portion 54. The elastic body 56 is constituted by a leaf spring and a seat portion 57 is placed thereon. The seat portion 57 has a tabular shape and an outer edge thereof and the inner peripheral surface of the protective cap H2 are spaced apart from each other such that the seat portion 57 can be displaced up and down inside the protective cap H2. The seat portion 57 is disposed on the opening 51 side with respect to the drain hole 55. Furthermore, the seat portion 57 and the cylindrical portion 53 are formed so that directions in which the surfaces of the seat portion 57 and the cylindrical portion 53 extend intersect each other such that the seat portion 57 will not be positioned along a line extended in the water flowing direction of the drain hole 55. A space A that sets the base 52 and the seat portion 57 apart from each other at a predetermined distance is provided.

Since the structure of the sprinkler head S2 is already known, detailed description thereof is omitted. Furthermore, components that are the same as those of the sprinkler head S1 of the first embodiment will be denoted with the same reference numerals. As illustrated in FIG. 6, the protective cap H2 is connected to the sprinkler head S2 by being fitted to the outer peripheral portion of the sprinkler head S2 or by being engaged with the traverse groove M that is carved on an outer peripheral portion of a body of the sprinkler head S2.

When the sprinkler head S2 is accommodated inside the protective cap H2, a lower end surface of the sprinkler head S2 sits on the seat portion 57, and with the function of the elastic body 56, the seat portion 57 is displaced towards the flange portion 54 side. In the above state, since the drain hole 55 is provided below the seat portion 57, even if water were to leak out to the inside of the protective cap H2 from the nozzle of the sprinkler head S2 or from the joint between the water supply pipe P and the male screw 23, since the water will promptly flow out from the drain hole 55, leakage can be easily identified.

Furthermore, in a case in which the ceiling is spray-painted, since the drain hole 55 is formed at the lower end of the cylindrical portion 53 such that, when viewed from below, the drain hole 55 is hidden by the flange portion 54 that protrudes outwardly with respect to the cylindrical portion 53, paint does not easily enter into the inside of the drain hole 55. Furthermore, even if paint intrudes into the protective cap H2 through the drain hole 55, since the seat portion 57 is not positioned along the line extended in the water flowing direction of the drain hole 55, the paint does not easily reach the seat portion 57. Moreover, the base 52 and the seat portion 57 are separated from each other by the space A; accordingly, the momentum of the paint is reduced and, as a result, the paint is prevented from reaching the seat portion 57. Even so, even if a minute amount of paint were to reach the vicinity of the seat portion 57, since the lower end surface of the sprinkler head S2 is covered and hidden by the seat portion 57, adhesion of paint to the lower end surface of the sprinkler head S2 can be prevented.

Figure 8:
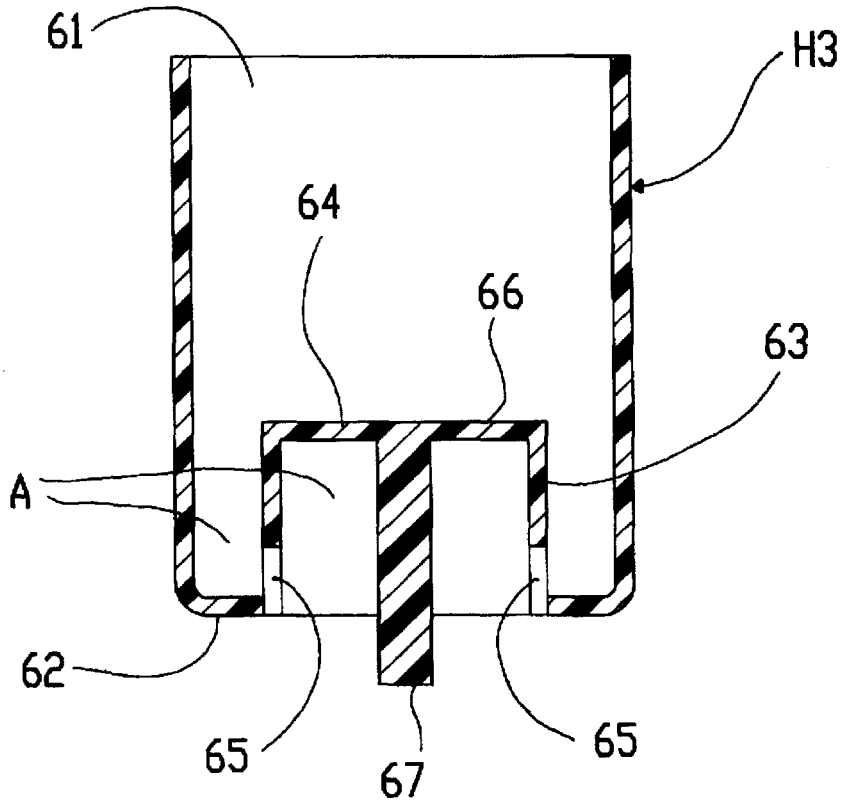
FIG. 8A is a cross-sectional view of a protective cap of a third embodiment.
FIG. 8B is a bottom view of the protective cap of the third embodiment.
Figure 8:
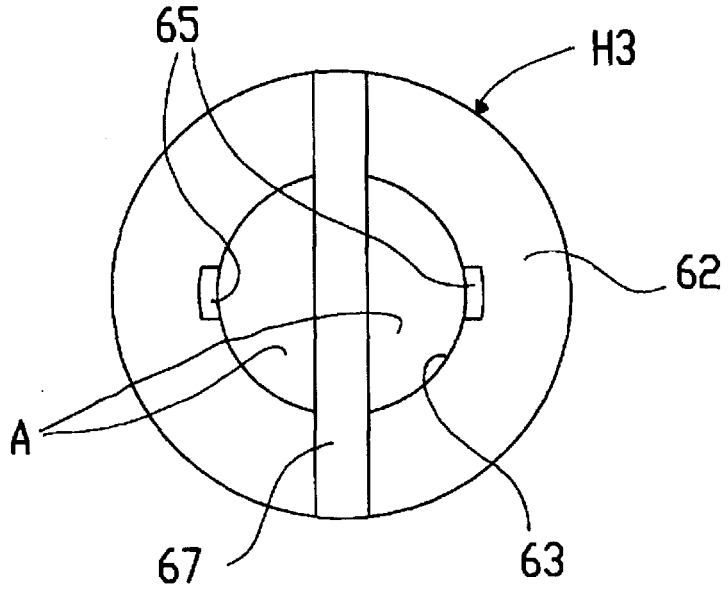

Third Embodiment (FIGS. 8A and 8B)

A protective cap H3 of a third embodiment illustrated in FIGS. 8A and 8B has a cylindrical shape and the sprinkler head S1 (not shown) is accommodated therein. An opening 61 is formed on an upper side of the protective cap H3 and a base 62 is formed on a lower side thereof. A cylindrical portion 63 having a cylindrical shape that extends towards the opening 61 from the base 62 is formed in a projecting manner.

An upper end face of the cylindrical portion 63 is a circular seat portion 64. An outer edge of the seat portion 64 and an inner peripheral surface of the protective cap H3 are spaced apart from each other. In the present embodiment, the cylindrical portion 63 projects towards the opening 61 from the base 62 in a perpendicular manner and intersects the seat portion 64; however, not limited to the above, the cylindrical portion 63 may be projected in an inclined manner or in a curved manner. Furthermore, similar to the first and second embodiments, a space A that sets the base 62 and the seat portion 64 apart from each other at a predetermined distance is provided.

A drain hole 65 is formed on the base 62 side of the cylindrical portion 63. Accordingly, by looking up at the protective cap H3 from below, water leaking from the sprinkler head S1 can be found easily. Furthermore, leaking water can be facilitated to flow towards the drain hole 65 that is formed below the seat portion 64. Accordingly, water can be discharged in a short time and a defect of overlooking the sprinkler head in which a leakage has occurred because of water not being discharged within the inspection time of the leak inspection will not occur.

Furthermore, the water flowing direction of the drain hole 65 and a seating surface 66 of the seat portion 64 on which the sprinkler head S1 sits are substantially parallel to each other such that the water flowing direction of the drain hole 65 and the seating surface 66 do not intersect each other. That is, the drain hole 65 is open towards an inner peripheral surface of the protective cap H3 on the base 62 side that is positioned below the seat portion 64. Along with the effect of the space A, the above makes it difficult for the paint to reach the seat portion 64. A gripping portion 67 that extends downwards is formed on a surface on the other side of the seating surface 66. The gripping portion 67 may be held by the fingers to pull out the protective cap H3 from the sprinkler head S1.

What is claimed is:

1. A cylindrical protective cap for a sprinkler head comprising:

an opening on an upper side thereof;

a base provided on a lower side thereof;

a drain hole at a base side of the protective cap;

a seat portion on which a surface of the sprinkler head sits being provided inside the protective cap on the base side; and a cylindrical portion extending from the base to the seat portion, wherein the seat portion is disposed on an opening side with respect to the drain hole, and an edge of the seat portion and an inner peripheral surface of the protective cap are spaced apart from each other, and a gripping portion is formed so as to extend downwards from the seat portion.

2. The protective cap for a sprinkler head according to claim 1, wherein a space is provided between the base and the seat portion, the space setting the base and the seat portion apart from each other at a predetermined distance, and the drain hole is provided in the space.

3. The protective cap for a sprinkler head according to claim 1, further comprising an extension portion provided in a lateral side of the protective cap, the extension portion formed so as to extend below the base.

4. The protective cap for a sprinkler head according to claim 3, wherein a space is provided between a lower end of the extension portion and the seat portion, the space setting the lower end of the extension portion and the seat portion apart from each other at a predetermined distance, and the drain hole is provided in the space.

5. The protective cap for a sprinkler head according to claim 1, wherein a flange portion is formed at the lower end of the protective cap, and the drain hole is provided on an inner side with respect to an edge of the flange portion.

6. The protective cap for a sprinkler head according to claim 1, wherein the seat portion covers and hides a lower end surface of the sprinkler head when the protective cap is mounted on the sprinkler head.

* * * * *